US010458749B1

(12) United States Patent
Zhang

(10) Patent No.: US 10,458,749 B1
(45) Date of Patent: Oct. 29, 2019

(54) WAIST PROTECTING PLATE STRUCTURE OF CONNECTING A HOLSTER AND A BELT BUCKLE

(71) Applicant: CYTAC TECHNOLOGY LIMITED, Shenzhen (CN)

(72) Inventor: Yong Zhang, Shenzhen (CN)

(73) Assignee: CYTAC TECHNOLOGY LIMITED, Shenzhen (CN)

( * ) Notice: Subject to any disclaimer, the term of this patent is extended or adjusted under 35 U.S.C. 154(b) by 0 days.

(21) Appl. No.: 15/954,824

(22) Filed: Apr. 17, 2018

(51) Int. Cl.
*F41C 33/04* (2006.01)
*A45F 5/02* (2006.01)

(52) U.S. Cl.
CPC ..... *F41C 33/041* (2013.01); *A45F 5/021* (2013.01); *A45F 2005/023* (2013.01); *A45F 2200/0591* (2013.01)

(58) Field of Classification Search
CPC .. F41C 33/045; F41C 33/0227; F41C 33/041; F41C 33/00; F41C 33/043; F41C 33/046; F41C 33/048; A45F 5/021; A45F 2005/023; A45F 2200/0591
See application file for complete search history.

(56) References Cited

U.S. PATENT DOCUMENTS 5,265,781 A * 11/1993 Nichols ..... F41C 33/0227 224/197
6,161,741 A * 12/2000 French ..... F41C 33/0227 224/192
9,664,480 B2 * 5/2017 Faifer ..... F41C 33/0209
2002/0070253 A1 * 6/2002 Beletsky ..... F41C 33/00 224/192
2005/0263552 A1 * 12/2005 Panosian ..... A45F 5/02 224/269
2017/0122701 A1 * 5/2017 Lim ..... A45F 5/021

* cited by examiner

*Primary Examiner* — Corey N Skurdal

(57) ABSTRACT

The present disclosure discloses a waist protecting plate structure of connecting a holster and a belt buckle, comprising a buckle-type waist protecting plate mounted inside the holster through a removable connection member; the buckle-type waist protecting plate is a two-layer structure with arc bending ends, wherein the layer close to the holster has a concave retaining portion matching with the connection member; the two-layer structure of the buckle-type waist protecting plate is provided a plurality of corresponding connection holes, through which it is convenient to convert the wearing angle and using type; there are two types, namely buckle-type and waist protecting type, thus facilitating quick conversion according to different using environments, and the buckle-type increases the anti-theft effect while waist protecting plate type facilitates the effects of easy removal.

9 Claims, 3 Drawing Sheets

WAIST PROTECTING PLATE STRUCTURE OF CONNECTING A HOLSTER AND A BELT BUCKLE

TECHNICAL FIELD

The present disclosure relates to the technical field of gun equipment, in particular, to a waist protecting structure connecting holster and belt buckle that has two switchable functions and is easy to remove.

BACKGROUND

Holster is an essential equipment for law enforcement officers such as the police, police with a gun and the army, and is used to carry, protect the pistol, to prevent the pistol from being robbed of. According to regulations in some countries, law enforcement officials and police officers with guns must ensure the safe placement of pistols when performing their duties.

Currently, the waist protecting and belt buck are separate mechanical parts. The waist protecting cannot be compatible with function of the belt buckle, and the two parts need to connect the holster individually. The waist protecting is not easy to remove from the holster or needs to use tools for removal. When squatting or waiting for other actions, those who wear guns cannot too much actions since a support is wore on the waist to connect the holster containing a gun and the holster is not easy to remove from the waist protecting mechanism on the waist.

Therefore, there is a need to design a holster wearing structure used in different situations.

CONTENT OF DISCLOSURE

To overcome drawbacks of prior art, the disclosure provides a waist protecting plate structure of connecting a holster and a belt buckle, which has two types of belt buckle and waist protecting plate that are easily-convertible according to different using situations. The waist protecting plate type has the function of anti-loss and easy-to-remove, and enhances the anti-theft function when converted into the buckle type.

The present disclosure employs the following technical solutions:

A waist protecting plate structure of connecting a holster and a belt buckle, comprising a buckle-type waist protecting plate mounted inside the holster through a removable connection member; the buckle-type waist protecting plate is a two-layer structure with arc bending ends, wherein the layer close to the holster has a concave retaining portion matching with the connection member; the two-layer structure of buckle-type waist protecting plate is provided a plurality of corresponding connection holes.

Further, the connection member has a vertical through slot, wherein one side of the slot has a buckle bump, and the other side of the slot has multiple rows of mounting holes.

Further, the connection member is connected with the holster by bolts.

Further, the retaining portion is L-shaped and types a slideway with the buckle-type waist protecting plate.

Further, the size of the slideway is matched with the size of the slot; the width of the retaining portion is less than or equal to the width of the slot, allowing the retaining portion to be easy to cooperate with the connection portion.

Further, the retaining portion provided with a positioning hole, and both sides of the positioning hole respectively have multiple rows of adjustment holes.

Further, the spacing between adjacent rows of adjustment holes is equal to the spacing between adjacent rows of mounting holes, allowing the mounting hole and the adjustment hole not to interfere with each other after connecting with the bolt.

Further, there is a screw in the connection holes between the two-layer structure of the buckle-type waist protecting plate, and the two ends of the screw are tightened by a nut; a space is formed between the screw and the top of the buckle-type waist protecting plate for the belt to pass through.

Further, the outer diameter of the nut is larger than the diameter of the connection holes.

Further, the length of one layer of the buckle-type waist protecting plate close to the holster is less than that of the layer away from the holster, and the layer away from the holster is used for the wearing of the support plate type.

Compared with the prior art, the disclosure has the following beneficial effects:

(1) The buckle-type waist protecting plate of the present disclosure is provided with connection holes, and different using types can be easily converted by choosing whether to install the screw in the connection hole to improve the practicality and convenience of the holster;

(2) When the present disclosure employs the waist protecting plate type, it is easy to remove the holster and waist protecting plate as a whole or remove the holster by engaging the retaining portion of buckle-type waist protecting plate into the slot of connection member in the bottom-up Specification direction and then allowing the buckle bump of connection member to be stuck in the positioning hole of the latching portion until they are locked with each other, thereby saving operating time and being suitable for shooting training and other operations;

(3) When the present disclosure employs the belt buckle type, it is secured at the waist by the belt which passes over the screws after the screws are passed through the connection holes and both ends of the screws are secured by nuts, thus increasing anti-theft function, improving safety and being suitable for duty work and so on.

Wherein, 1—holster, 2—buckle-type waist protecting plate, 3—connection member, 4—retaining portion, 5—adjustment hole, 6—screw, 7—connection hole, 8—positioning hole, 9—slideway, 10—slot, 11—buckle bump, 12—mounting hole, 13—first connection portion, 14—second connection portion.

DETAILED DESCRIPTION OF THE EMBODIMENTS

Embodiment 1

As shown in FIG. 1-6, the present application provides a waist protecting structure connecting holster and belt buckle, comprising a buckle-type waist protecting plate 2, a retaining portion 4 and a connection member 3. The retaining portion 4 is secured on one side of the buckle-type waist protecting plate 2. The connection member 3 is securely mounted inside the holster 1. The buckle-type waist protecting plate 2 and the holster 1 are engaged with each other by the retaining portion 4 and the connection member 3.

Figure 1:
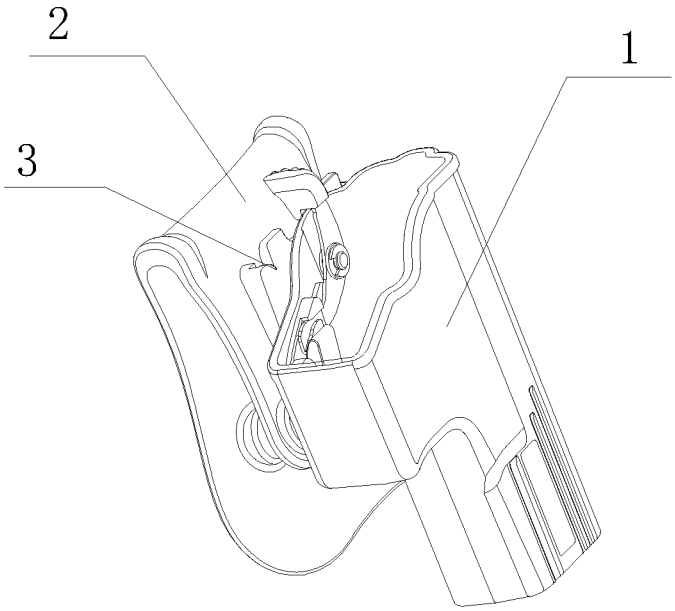
FIG. 1 is a whole-structure view of the present disclosure.
Figure 2:
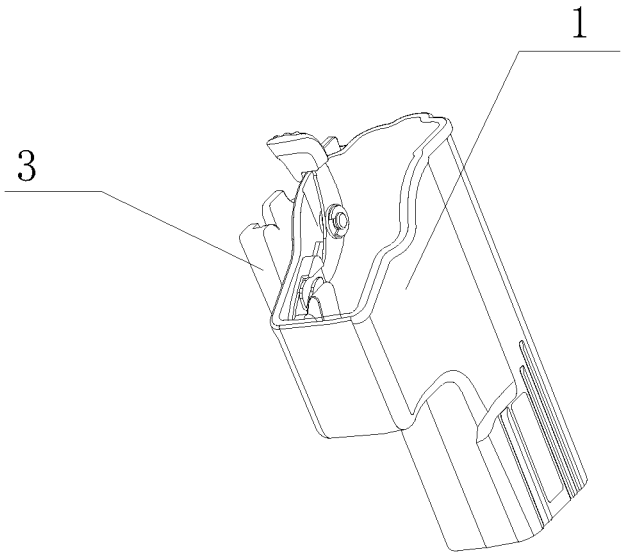
FIG. 2 is a view illustrating the installation of the connection member and holster of the disclosure.
Figure 3:
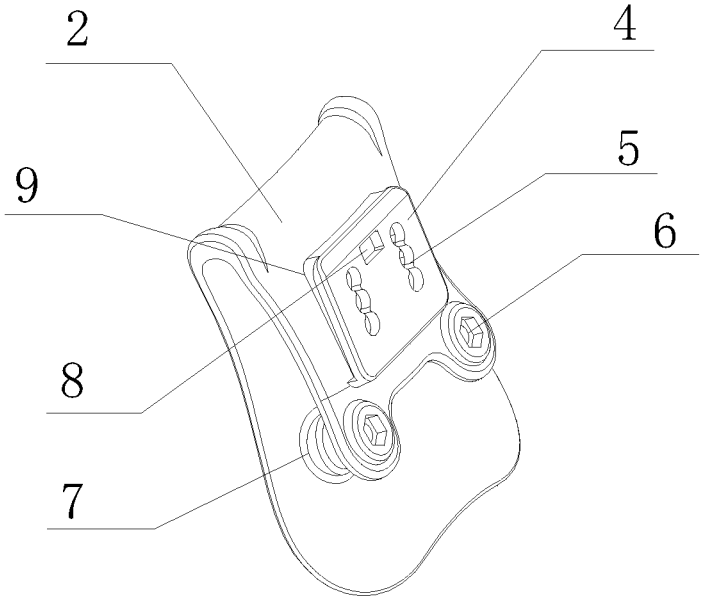
FIG. 3 is a structure view of the buckle-type waist protecting plate for the disclosure.
Figure 4:
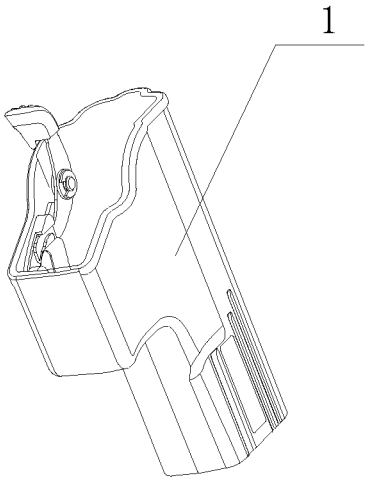
FIG. 4 is a structure view of the holster for the disclosure.

As shown in FIG. 3, the buckle-type waist protecting plate 2 a two-layer structure with arc bending ends, wherein the length of its inner layer (one side close to the holster 1) is smaller than that of the outer layer; the holster 1 is wore through engaging the outer layer of the buckle-type waist protecting plate 2 into the waist; the inner layer and the outer layer are respectively provided with two connection holes 7 at corresponding positions.

The side of inner layer of the buckle-type waist protecting plate 2 is fixed with a retaining portion 4. The retaining portion 4 includes a first connection portion 13 and a second connection portion 14. The first connection portion 13 and the second connection portion 14 type form an L shape. The first connection portion 13 is connected with the inner layer of the buckle-type waist protecting plate 2 and the second connection portion 14 is used to engage with the connection member 3. A slideway 9 is formed between the second connection portion 14 of the retaining portion 4 and the inner layer of the buckle-type waist protecting plate 2.

The upper position of the second connection portion 14 of the retaining portion 4 is provided with a positioning hole 8. Two sides of the positioning hole 8 are provided with a row of adjustment holes 5 respectively. Each row of adjustment holes 5 includes three or more than three holes. The adjacent adjustment holes 5 are communicated with each other.

Figure 5:
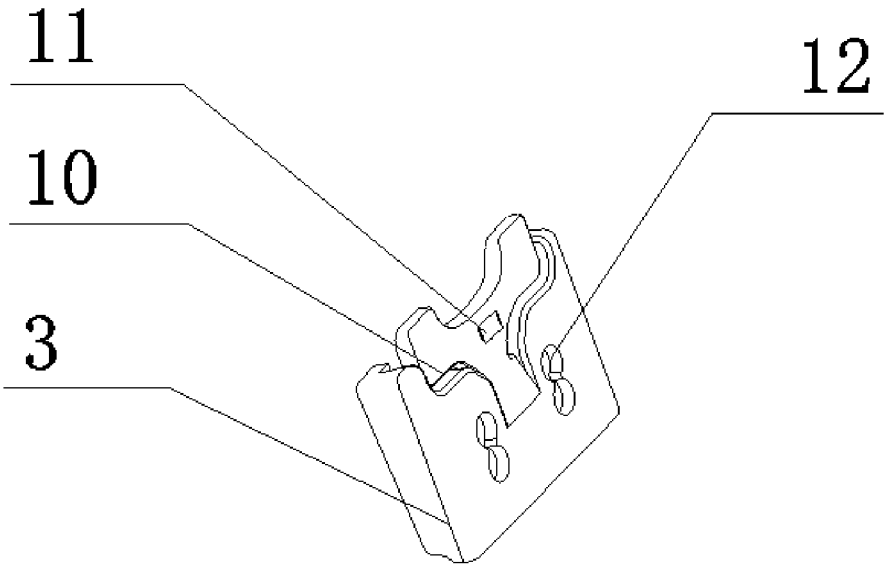
FIG. 5 is a structure view of the connection member for the disclosure.
Figure 6:
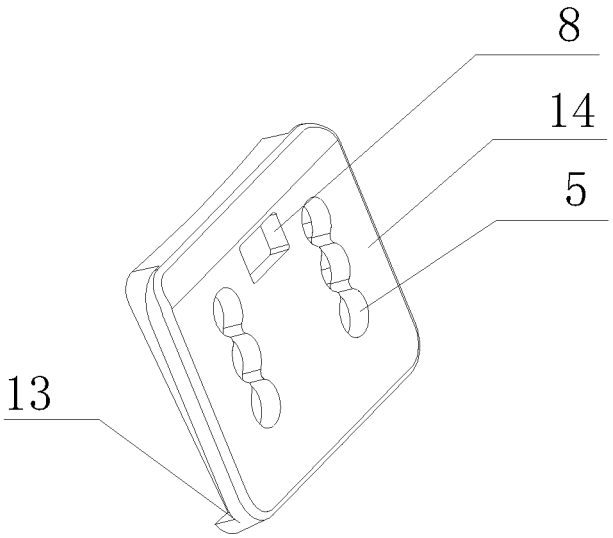
FIG. 6 is a structure view of the retaining portion for the disclosure.

As shown in FIG. 5, the connection member 3 is provided with a slot 10 that penetrates up and down. The slot 10 has two rows of mounting holes 12 on one side. Each row of mounting holes 12 includes two or more than two holes. The adjacent mounting holes 12 are communicated with each other.

The adjustment hole 5 is used to adjust the passing-through of the head of bolt. The spacing between two rows of mounting holes 12 is equal to the spacing between two rows of adjustment holes 5 such that the installation of bolts is prevent from affecting the engagement of the retaining portion 4 and the connection member 3, thereby ensuring the mounting hole 12 and the adjustment hole 5 not to interfere with each other after connecting with the bolt.

The size of the slideway 9 is matched with the size of the slot 10. The retaining portion 4 is snapped into the slot 10 by the slideway 9. The width of the retaining portion 4 is less than or equal to the width of the slot 10.

The connection member 3 is secured to the side of the holster 1 by the bolt passing through the mounting hole 12.

The other side of the slot 10 is provided with a buckle bump 11 and the buckle bump 11 is engaged with the positioning hole 8 on the retaining portion 4.

The present application includes two types, namely the waist protecting plate type and the buckle type.

The waist protecting plate type is suitable for shooting training and other operations, wherein the retaining portion 4 of buckle-type waist protecting plate 2 is engaged into the slot 10 of connection member 3 in the bottom-up direction to allow the buckle bump 11 of connection member 3 to be stuck in the positioning hole 8 of the retaining portion 4 until they are locked with each other. It can be stuck at the waist when worn so that it is convenient to remove the holster 1 with the buckle-type waist protecting plate 2 from the waist as a whole during the rest; or to easily remove the holster 1 from the buckle-type waist protecting plate 2.

The belt buckle type is suitable for duty work and so on. A screw 6 passes through the connection holes 7 between the two-layer structure employed by the buckle-type waist protecting plate 2, and the two ends of the screw 6 are tightened by a nut; a space is formed between the screw 6 and the top of the buckle-type waist protecting plate 2 for the belt to pass through. It can be fixed to the waist with a belt after passing the screw 6 through the upper space when in use; the anti-theft function is increased through the form of fixing a belt to improve safety.

The holster wearing mode of the present application can be quickly and conveniently switched, increasing its versatility and convenience, bringing great convenience to duty officers while increasing the safety and usability of firearms.

The foregoing is merely illustrative of the preferred embodiments of the present application and is not intended to be limiting of the present application, and various changes and modifications may be made by those skilled in the art. Any modifications, equivalent substitutions, improvements, and the like within the spirit and principles of the application are intended to be included within the scope of the present application.

I claim:

1. A waist protecting plate structure of connecting a holster and a belt buckle, characterized by comprising a buckle-type waist protecting plate mounted inside the holster through a removable connection member;

the buckle-type waist protecting plate is a two-layer structure with arc bending ends, wherein the layer close to the holster has a concave retaining portion matching with the connection member; the two-layer structure of the buckle-type waist protecting plate is provided a plurality of corresponding connection holes;

the connection member has a vertical through slot, wherein one side of the slot has a buckle bump, and the other side of the slot has multiple rows of mounting holes.

2. The waist protecting plate structure of connecting a holster and a belt buckle according to claim 1, characterized in that the connection member is connected with the holster by bolts.

3. The waist protecting plate structure of connecting a holster and a belt buckle according to claim 1, characterized in that the retaining portion is L-shaped and types a slideway with the buckle-type waist protecting plate.

4. The waist protecting plate structure of connecting a holster and a belt buckle according to claim 3, characterized in that the size of the slideway is matched with the size of the slot; the width of the retaining portion is less than or equal to the width of the slot.

5. The waist protecting plate structure of connecting a holster and a belt buckle according to claim 3, characterized in that the retaining portion provided with a positioning hole, and both sides of the positioning hole respectively have multiple rows of adjustment holes.

6. The waist protecting plate structure of connecting a holster and a belt buckle according to claim 5, characterized in that the spacing between adjacent rows of adjustment holes is equal to the spacing between adjacent rows of mounting holes.

7. The waist protecting plate structure of connecting a holster and a belt buckle according to claim 1, characterized in that there is a screw in the connection holes between the two-layer structure of the buckle-type waist protecting plate, and the two ends of the screw are tightened by a nut; a space is formed between the screw and the top of the buckle-type waist protecting plate for the belt to pass through.

8. The waist protecting plate structure of connecting a holster and a belt buckle according to claim 7, characterized in that the outer diameter of the nut is larger than the diameter of the connection hole.

9. The waist protecting plate structure of connecting a holster and a belt buckle according to claim 1, characterized in that the length of one layer of the buckle-type waist protecting plate close to the holster is less than that of the layer away from the holster.

* * * * *